US007476044B2

(12) United States Patent
Gueret

(10) Patent No.: US 7,476,044 B2
(45) Date of Patent: Jan. 13, 2009

(54) PACKAGING AND APPLICATOR DEVICE INCLUDING A WIPER MEMBER

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 198 days.

(21) Appl. No.: 11/049,703

(22) Filed: Feb. 4, 2005

(65) Prior Publication Data

US 2005/0175394 A1 Aug. 11, 2005

Related U.S. Application Data

(60) Provisional application No. 60/551,804, filed on Mar. 11, 2004.

(30) Foreign Application Priority Data

Feb. 6, 2004 (FR) ..... 04 50223

(51) Int. Cl.
*A45B 11/00* (2006.01)

(52) U.S. Cl. ..... 401/122; 401/121; 401/126; 401/129; 401/118

(58) Field of Classification Search ..... 401/122, 401/121, 126, 129, 118; 132/218
See application file for complete search history.

(56) References Cited

U.S. PATENT DOCUMENTS

| | | | | |
|---|---|---|---|---|
| 3,214,782 | A | 11/1965 | Masters et al. | |
| 3,384,547 | A | 5/1968 | Palmerio et al. | |
| 3,930,280 | A * | 1/1976 | Vasas | 401/122 |
| 4,126,144 | A | 11/1978 | Durate | |
| 4,407,311 | A * | 10/1983 | Gueret | 401/122 |
| 4,705,053 | A * | 11/1987 | Goncalves | 401/122 |
| 5,490,737 | A | 2/1996 | Gueret | |
| 5,716,150 | A * | 2/1998 | Gueret | 401/129 |
| 5,803,638 | A | 9/1998 | Gueret | |
| 5,860,432 | A | 1/1999 | Gueret | |
| 5,876,138 | A | 3/1999 | Gueret | |
| 5,937,869 | A * | 8/1999 | Lhuisset | 132/218 |
| 6,010,265 | A * | 1/2000 | Bouix | 401/122 |
| 6,033,142 | A | 3/2000 | Gueret | |
| 6,395,301 | B1 * | 5/2002 | Cantin | 401/126 |
| 6,669,389 | B2 * | 12/2003 | Gueret | 401/122 |

(Continued)

FOREIGN PATENT DOCUMENTS

| | | |
|---|---|---|
| CA | 2251997 | 5/1999 |

(Continued)

OTHER PUBLICATIONS

EPO Patent Document.

(Continued)

*Primary Examiner*—Khoa D Huynh
(74) *Attorney, Agent, or Firm*—Oliff & Berridge, PLC

(57) ABSTRACT

A packaging and applicator device may include: a receptacle; a substance containing macroparticles, such as fibers and/or flakes, the substance being contained in the receptacle; an applicator including a stem and an applicator member capable of being inserted into the receptacle to take the substance therefrom; and a wiper member including a first insertion cone inside the receptacle, said first insertion cone converging toward the outlet of the receptacle, the wiper member having an inside surface which, at at least one point along the longitudinal axis of the wiper member, is substantially continuously circular with a diameter adapted to wiping the stem.

42 Claims, 2 Drawing Sheets

U.S. PATENT DOCUMENTS 6,945,723 B1 * 9/2005 Gueret ..... 401/130

FOREIGN PATENT DOCUMENTS

| | | | |
|---|---|---|---|
| DE | 44 13 430 | A1 | 10/1995 |
| DE | 197 38 247 | A1 | 3/1999 |
| DE | 197 44 181 | A1 | 4/1999 |
| EP | 0 224 457 | | 6/1987 |
| EP | 0 611 170 | A1 | 8/1994 |
| EP | 0 611 170 | B1 | 8/1994 |
| EP | 0 875 234 | A1 | 11/1998 |
| EP | 1 070 468 | A1 | 1/2001 |
| FR | 2 705 876 | | 12/1994 |
| FR | 2 730 911 | | 8/1996 |
| FR | 2 753 058 | | 3/1998 |

OTHER PUBLICATIONS

German Opposition Brief w/English Translation.

* cited by examiner

PACKAGING AND APPLICATOR DEVICE INCLUDING A WIPER MEMBER

This non provisional application claims the benefit of French Application No. 04 50223 filed on Feb. 6, 2004 and U.S. Provisional Application No. 60/551,804 filed on Mar. 11, 2004.

BACKGROUND

The present invention relates to devices for packaging and applying a substance including macroparticles, such as, for example, a cosmetic.

The term "macroparticles" extends, for example, to include particles that are not spherical, being elongate in shape, and individually perceivable by the naked eye. The term also encompasses fibers intended, for example, to lengthen the eyelashes and/or to produce aesthetic effects, such as concerning color and/or gloss. Flakes constitute another example of macroparticles.

Numerous packaging and applicator devices are known that comprise a receptacle, a cosmetic contained in the receptacle, an applicator comprising a brush capable of being inserted in the receptacle in order to take the cosmetic, and a wiper member comprising an elongate passage through which the brush passes longitudinally on being withdrawn from the receptacle.

In such devices, the wiper member serves firstly to wipe the stem and secondly to remove excess cosmetic from the brush.

U.S. Pat. No. 3,214,782 relates to a device for packaging and applying a mascara that can contain short fibers, the device including an applicator and a wiper member having notches extending parallel to the longitudinal axis of the device. The applicator includes a stem of diameter that corresponds to the diameter of the wiper member in the region of the notches.

SUMMARY

The Applicant has found that when such prior art devices are used with a substance containing fibers or flakes, the fibers and flakes that manage to pass through the wiper member are situated between the bristles of the brush close to the core thereof, i.e., they are those fibers and flakes that have not encountered the wiper member. In contrast, the fibers or flakes that were situated on the surface of the brush tend to agglutinate at the inlet to the wiper member. This can result in the fibers or flakes not being used in the desired manner, which can degrade the quality of the makeup effect. For example, during wiping using a device according to the '782 patent, the notches leave traces of mascara on the stem and on the brush.

There exists a need to improve specifically the quality with which the applicator member is wiped when the substance contains macroparticles, such as fibers or flakes, for example.

Exemplary embodiments of the invention provide a novel packaging and applicator device that is of relatively simple construction and that makes it possible, for example, to remedy the above-outlined drawbacks of known devices, when the substance contains macroparticles.

Exemplary embodiments of the invention provide a device comprising: a receptacle; a substance containing macroparticles, such as fibers and/or flakes, the substance being contained in the receptacle; an applicator comprising a stem and an applicator member capable of being inserted into the receptacle to take the substance therefrom; and a wiper member including a first insertion cone inside the receptacle, said first insertion cone converging toward the outlet of the receptacle, the wiper member comprising an inside surface which, at least one point along the longitudinal axis of the wiper member, is substantially continuously circular and of diameter adapted to wiping the stem.

Such a device may enable the applicator to be wiped in spite of the presence of macroparticles, and also may also present the advantage of not forming traces on the stem, unlike the device described in the '782 patent.

By the term "substantially continuously circular," it should be understood that over at least a portion of the length of the stem, the wiper member wipes substantially all of the substance from the entire circumference of the stem so that substantially no significant trace of substance remains on the stem, for example, no trace similar to that which can be observed during use of the device described in the '782 patent.

The wiper member may include at least one notch that is not circularly symmetrical about the longitudinal axis of the wiper member and into which the applicator member and/or the substance on the applicator member may penetrate at least in part while the applicator member is passing through the wiper member.

Exemplary embodiments of the invention provide a device comprising: a receptacle; a substance containing macroparticles, such as fibers and/or flakes, the substance being contained in the receptacle; an applicator including an applicator member capable of being inserted in the receptacle to take the substance; and a wiper member including at least one notch that is not circularly symmetrical about the longitudinal axis of the wiper member and into which the applicator member and/or the substance on the applicator member may penetrate at least in part while the applicator member is passing through the wiper member.

In various exemplary embodiments, it is possible to benefit from a packaging and applicator device suitable for making it easier for macroparticles to pass through the wiper member. The notch may define at least one zone of reduced wiping, and may reduce the risk of residual aggregates of fibers and/or flakes forming on the wiper member.

Exemplary embodiments of the wiper member may also make it possible to channel and/or orient the macroparticles better before and/or while passing through the wiper member.

Exemplary embodiments of the invention may also make it possible to provide a wiper member that encourages or facilitates the presence of macroparticles on the surface of the applicator member, once the applicator member has been wiped.

In exemplary embodiments, the wiper member may include an elongate passage through which the applicator member passes. The passage in the wiper member may comprise, at at least one point along a length thereof, a cross-section that is not continuously circular. For example, the passage may comprise be the above-described notch, which, by opening into the passage, may cause the cross-section to be not continuously circular at at least one point along the length of the passage.

The above-described notch may optionally open into an outer surface of the wiper member situated inside the receptacle. For example, the notch need not be a through notch in the radial direction. When the notch comprises a through notch, the notch may be formed between teeth situated at a longitudinal end of the wiper member which is situated inside the receptacle, the teeth extending in the axial direction.

The notch may include a circumferential dimension that decreases toward the outlet of the receptacle and/or a radial dimension that decreases toward the outlet of the receptacle.

Such a decrease may lead to the macroparticles becoming progressively oriented on the applicator member. For example, fibers and/or flakes may progressively take up an orientation substantially parallel to a direction in which the applicator moves while being extracted from the receptacle, which may then make it easier for the fibers and/or flakes subsequently to go through the remainder of the wiper member.

In exemplary embodiments including a notch, the macroparticles may also be channeled by the notch toward a predefined region of the wiper member, e.g., a region where the macroparticles are subjected to less wiping than elsewhere. Less energetic wiping may reduce the risk of the fibers and/or flakes becoming deeply buried in the substance after passing through the wiper member, and/or may improve the distribution of the fibers and/or flakes on the applicator member.

In exemplary embodiments, the wiper member may make it possible to use a substance having a higher concentration by weight of macroparticles.

In exemplary embodiments, the notch may open at a longitudinal end of the wiper member which is situated inside the receptacle. This may make it possible to act on the fibers and/or flakes as soon as the applicator member enters into the wiper member while the applicator is being withdrawn from the receptacle.

The wiper member may have more than one notch. For example, the wiper member may have two to ten notches, two to eight notches, or three to six notches, for example. Such notches may advantageously be uniformly distributed angularly along the longitudinal axis of the wiper member. The wiper member may be axially symmetrical.

On the inside of the receptacle, the wiper member may include a first insertion cone converging toward the outlet of the receptacle, and at least two splines projecting from the first insertion cone and defining between them at least one such notch. The first insertion cone may enable wiping to take place in a somewhat progressive manner. The splines may extend longitudinally parallel to the longitudinal axis of the wiper member.

The first insertion cone may include a relative variation in its section of at least 10% in a direction toward the outlet of the receptacle. The angle made by a generator line of the insertion cone relative to the longitudinal axis of the wiper member may remain within 60°, or even 45°, for example.

In exemplary embodiments, the wiper member may include a second insertion cone diverging toward the outlet of the receptacle, which may make it easier to return the applicator member into the receptacle. The first and second insertion cones may meet, or may be spaced apart by an annular throat of inside diameter that may correspond substantially to the outside diameter of the stem.

In exemplary embodiments, the receptacle may include a neck and the wiper member may include an assembly skirt serving to fasten the wiper member in the neck. Where appropriate, the wiper member may have an annular rim defining a groove in which a top end of the neck may be engaged. Inside the receptacle, the wiper member may have a wiper lip with an outer cross-section that is less than an outer cross-section of the assembly skirt.

In exemplary embodiments, the wiper lip may be connected to the assembly skirt via an intermediate portion that internally defines the second insertion cone.

In exemplary embodiments, the wiper lip may define a portion of the passage in the wiper member through which the applicator member passes. In exemplary embodiments, this portion may include an inside cross-section that is not entirely circular, at at least one point along its length. The above-described notch(es) may extend over all or part of a length of the wiper lip.

In exemplary embodiments, an overall diameter of the portion of the wiper member which includes the notch(es) may be substantially constant and may be equal to an inside diameter of the neck.

In exemplary embodiments, the wiper member need not have a slot that is substantially closed at rest and that extends longitudinally, unlike certain known wiper members that are designed to deform radially to a considerable extent when the applicator member passes therethrough.

In exemplary embodiments, the applicator member may be secured to an end of an applicator stem with a cross-section that may be substantially constant. Under such circumstances, a smallest section of the passage may correspond substantially to the outside cross-section of the stem.

In exemplary embodiments, the wiper member may retain a shape that is substantially constant while the applicator is being withdrawn. For example, the wiper member need not expand perceptibly while the applicator member is passing through. The inside section of the passage may increase, for example, by no more than 10% while the applicator member is passing therethrough. The stem may include a narrowed portion that becomes positioned next to (level) with the wiper member when the applicator is in place on the receptacle, e.g., inserted therein.

The wiper member may include flocking over all or part of its inside surface.

The wiper member may be made of a plastics material, e.g., a non-cellular material, e.g., an elastomer. Further, the wiper member may be made out of a foam or out of a material other than a plastics material, such as a ceramic.

The wiper member may be a single monolithic piece, or alternatively may comprise an assembly of at least two parts. The two parts may be made out of two different materials, for example, materials having different hardnesses.

The wiper member may also be overmolded onto the receptacle.

The applicator member may comprise a brush, which may comprise any shape that is appropriate for the making-up to be performed. In exemplary embodiments, a proximal end of the brush may comprise an envelope surface of cross-section that tapers in a direction away from a distal end of the brush. Such a decrease in cross-section, which may be obtained by a chamfer, for example, may further facilitate passage of macroparticles through the wiper member.

The stem may comprise a distal portion that tapers toward the applicator member, for example, a distal portion that is conical, which may improve the quality of wiping.

In exemplary embodiments, the brush may comprise an envelope surface of cross-section that passes through a maximum between longitudinal ends thereof. Such a brush in combination with a wiper member according to exemplary embodiments of the invention may make it possible to obtain wiping that is progressive.

In exemplary embodiments, the brush may comprise an envelope surface of cross-section that passes through a minimum between longitudinal ends thereof.

The brush may have a left-hand pitch, for example, as described in European Patent No. 0 611 170, the entirety of which is incorporated herein by reference. The orientation of the bristles that results therefrom may make it possible on passing through the wiper member to obtain a distribution and/or an orientation of the macroparticles that is particularly suitable for obtaining certain makeup effects.

The substance may include only fibers, only flakes, or a mixture of fibers and flakes. The fibers may have a mean length lying in a range of about 0.05 millimeters (mm) to about 3 mm, for example. The substance may include flakes having a mean maximum dimension lying in a range of about 50 micrometers (μm) to about 1.5 mm, for example.

The substance may contain at least 0.2% by weight of macroparticles, e.g., fibers and/or flakes.

The substance may be for application to the eyelashes and/or the eyebrows. The substance may be a mascara, for example.

Exemplary embodiments of the invention provide a packaging and applicator device comprising: a receptacle having a neck; a substance containing macroparticles, such as fibers and/or flakes, the substance being contained in the receptacle; an applicator including an applicator member capable of being inserted into the receptacle to take the substance; and a wiper member including at least one of the following characteristics:

the wiper member may be secured to the neck of the receptacle and may include at least one notch that is not circularly symmetrical about the longitudinal axis of the wiper member and into which the applicator member and/or the substance present thereon may penetrate at least in part while the applicator member is passing through the wiper member;

the wiper member may comprise a rim which bears against an edge of the neck of the receptacle and may include at least one notch that is not circularly symmetrical about the longitudinal axis of the wiper member and into which the applicator member and/or the substance present thereon may penetrate at least in part while the applicator member is passing through the wiper member.

Exemplary embodiments of the invention provide a packaging and applicator device comprising: a receptacle; a substance containing macroparticles, such as fibers and/or flakes, the substance being contained in the receptacle; an applicator comprising an applicator member capable of being inserted into the receptacle to take the substance; and a wiper member including at least one of the following characteristics:

the wiper member may be secured to the receptacle by snap-fastening and may include at least one notch that is not circularly symmetrical about the longitudinal axis of the wiper member and into which the applicator member and/or the substance present thereon may penetrate at least in part while the applicator member is passing through the wiper member;

the wiper member may include at least one notch with a circumferential dimension that decreases toward the outlet of the receptacle, said at least one notch possibly being not circularly symmetrical about the longitudinal axis of the wiper member, and the applicator member and/or the substance present thereon may penetrate at least in part while the applicator member is passing through the wiper member;

the wiper member may include at least one notch opening into an outer surface of the wiper member situated inside the receptacle, said at least one notch possibly being not circularly symmetrical about the longitudinal axis of the wiper member, and the applicator member and/or the substance present thereon may penetrate at least in part while the applicator member is passing through the wiper member;

the wiper member may include a passage through which the applicator member passes longitudinally while being withdrawn from the receptacle, and the wiper member may include a first insertion cone on an inside of the receptacle, said first insertion cone: either converging toward the outlet of the receptacle, said wiper member having at least two splines which project into the first insertion cone, or defining a bottom of at least one notch formed between two splines projecting from a surface thereof;

the wiper member may be is elastically deformable and may include at least one notch that is that is not circularly symmetrical about the longitudinal axis of the wiper member and into which the applicator member and/or the substance present thereon may penetrate at least in part while the applicator member is passing through the wiper member;

the wiper member disposed with at least a portion of its outer surface inside the receptacle, said portion may be spaced apart from the inside surface of the receptacle and may include at least one notch that is not circularly symmetrical about the longitudinal axis of the wiper member, and the applicator member and/or the substance present thereon may penetrate at least in part while the applicator member is passing through the wiper member;

the wiper member may include a passage through which the applicator member passes longitudinally while being withdrawn from the receptacle, the wiper member may include a first insertion cone on the inside of the receptacle, said insertion cone converging toward the outlet of the receptacle, at least one spline possibly may project from said first insertion cone, at least one notch possibly opening out into said first insertion cone, which may also define a bottom of at least one notch formed between two splines projecting from a surface thereof; and the wiper member may not deform perceptibly while the applicator member is passing therethrough and may comprise an inside section that varies over a major fraction of a distance between a distal end of the wiper member and a location where the section passes through a minimum.

Independently or in combination with the above, exemplary embodiments of the invention may provide a packaging and applicator device comprising: a receptacle; a substance containing macroparticles, such as fibers and/or flakes, the substance being contained in the receptacle; an applicator including an applicator member capable of being inserted into the receptacle to take the substance; and a wiper member comprising a passage through which the applicator member passes longitudinally while being withdrawn from the receptacle, the wiper member having a first insertion cone on an inside of the receptacle, said insertion cone converging toward the outlet of the receptacle. At least one spline may project from said first insertion cone. At least one notch may open into said first insertion cone. The cone may also define a bottom of at least one notch formed between two splines projecting from a surface thereof.

Independently or in combination with the above, exemplary embodiments of the invention may provide a packaging and applicator device comprising: a receptacle capable of optionally containing macroparticles, such as fibers and/or flakes; an applicator including an applicator member capable of being inserted in the receptacle in order to take the substance; and a wiper member comprising a passage through which the applicator member passes longitudinally while being withdrawn from the receptacle, the passage including, at at least one point along a length thereof, a cross-section that is not continuously circular, the wiper member being substantially non-deformable when the applicator member passes therethrough. Such a wiper member may enable certain regions of the applicator member to be wiped preferentially, for example.

Independently or in combination with the above, exemplary embodiments of the present invention may provide a packaging and applicator device enabling wiping to be performed in a particularly progressive manner, the device comprising: a receptacle; an applicator including an applicator member capable of being inserted into the receptacle to take the substance; a wiper member that does not deform perceptibly while the applicator member is passing therethrough, the wiper member comprising an inside section that varies over a major fraction of a distance between a distal end of the wiper member and a location where the section passes through a minimum. For example, the wiper member need not have a circularly cylindrical surface prior to reaching its minimum section, when traveling in a receptacle-exiting direction.

Exemplary embodiments of the invention provide a packaging device comprising: a receptacle; an applicator comprising an applicator member enabling substance to be taken from the receptacle; and a wiper member including at least one of the following characteristics:

- the wiper member may not deform perceptibly while the applicator is being extracted from the receptacle and may include an inside section that decreases in a direction toward the outlet of the receptacle with a profile that is generally convex toward the inside or rectilinear, for example, conical with a rectilinear generator line—such a device may also enable wiping to be performed progressively;
- the wiper member may not deform perceptibly while the applicator is being extracted from the receptacle and may include an inside section that decreases in a direction toward the outlet of the receptacle without making an angle greater than 60° relative to the longitudinal axis of the wiper member, and, for example, without making substantially a right angle—such a wiper member may make it easier for macroparticles to pass through; and
- the wiper member may not deform perceptibly while the applicator member is passing through and may include presents an inside section that varies over a major fraction of a distance between a distal end of the wiper member and a location where the section passes through a minimum.

Exemplary embodiments of the invention provide such a wiper member per se.

Independently or in combination with the above, exemplary embodiments of the present invention provide a method of making-up in which an applicator member is used to take substance from a receptacle provided with a wiper member, the substance including macroparticles, and in which, during withdrawal of the applicator, the macroparticles are subjected to action that tends to orient the macroparticles in a predefined manner on the applicator member, after which the substance is applied to a region of the human body, such as the eyelashes and/or the eyebrows. The action may, for example, orient the macroparticles substantially parallel to the longitudinal axis of the applicator member.

Independently or in combination with the above, exemplary embodiments of the present invention provide a method of making-up in which an applicator member is used to take substance from a receptacle provided with a wiper member, the substance including macroparticles, and in which the macroparticles are subjected to wiping in a progressive manner, after which the substance is applied.

BRIEF DESCRIPTION OF THE DRAWINGS

The invention may be better understood on reading the following detailed description of non-limiting embodiments thereof, and on examining the accompanying drawings, in which.

DETAILED DESCRIPTION OF EMBODIMENTS

Figure 1:
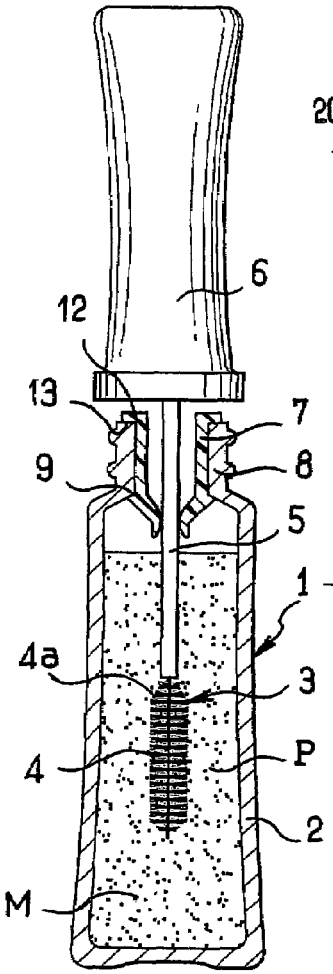
FIG. 1 is a diagrammatic view, partially in axial section, showing a packaging and applicator device according to a first exemplary embodiment.

FIG. 1 shows an exemplary packaging and applicator device 1, comprising a receptacle 2 filled with a substance P containing macroparticles M, such as fibers and/or flakes, for example.

For example, the substance P may contain fibers having a mean length lying in a range of about 0.05 mm to about 3 mm. The substance P may, alternatively or additionally, contain flakes, for example, flakes having a mean greatest dimension lying in a range of about 50 μm to about 1.5 mm.

For example, the substance P nay includes 0.2% by weight of fibers and/or flakes.

The device 1 may further comprise an applicator 3 comprising an applicator member 4 at a first end of a stem 5, with a second end of the stem 5 being connected to a cap 6 for closing the receptacle 2 and suitable for screwing onto the receptacle 2.

In the exemplary embodiment shown in FIG. 1, the stem 5 is of substantially constant circular section; however, it is contemplated that the stem of the applicator may have a flattened section, for example.

In the exemplary embodiment shown in FIG. 1, the substance P may be a mascara including fibers and/or flakes, and the applicator member 4 may be a brush comprising a twisted core, for example, formed by a metal wire folded into a U-shape and twisted righthandedly or lefthandedly, the bristles being held between turns of the core. It is contemplated that the brush may comprise a non-twisted core or some other kind.

In the exemplary embodiment shown in FIG. 1, the bristles of the brush 4 may extend all around the core; however, it is contemplated that the bristles may extend over a smaller angular sector. The brush may include at least one concave facet or indentation.

Figure 15:
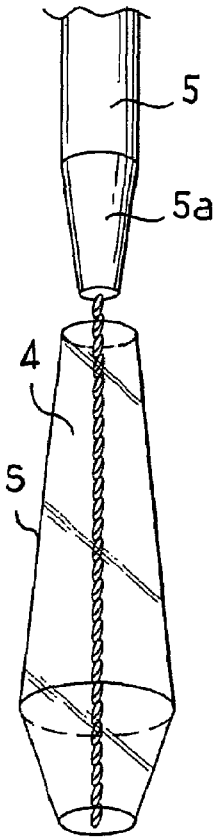
FIGS. 15 and 16 are elevation views showing examples of brushes that may advantageously be used in association with a wiper member.
Figure 16:
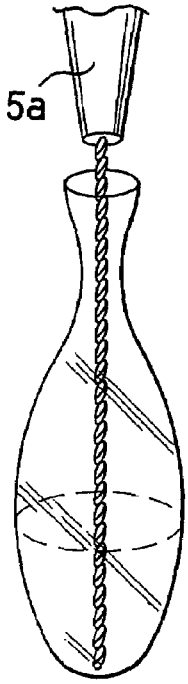

At a proximal end thereof, the brush 4 may include a chamfer 4*a*.

Where appropriate or desired, the brush 4 may comprise an envelope surface S with a cross-section that is not constant, e.g., passing solely though a maximum, as shown in FIG. 15, or through both a minimum and a maximum, as shown in FIG. 16.

The brush 4 may be similar to that described in U.S. Pat. No. 5,876,138, for example, with a minimum section possibly being smaller than a smallest section of the passage through the wiper member.

As shown in FIGS. 15 and 16, the stem 5 may have a narrowed portion 5*a* at a distal end thereof, for example, with a conical shape. The presence of such a portion 5*a* may contribute to further improving wiping.

In the exemplary embodiment shown in FIG. 1, the longitudinal axis of the applicator member 4 coincides with the longitudinal axis of the stem 5; however, the longitudinal axis of the applicator member 4 may be oriented differently, for example, substantially perpendicularly to the longitudinal axis of the stem, as may apply, for example, when using a flat stem. The applicator member 4 may also be a brush having a non-rectilinear core. The applicator member 4 may include bristles of different kinds and/or different lengths.

The exemplary device 1 may include a wiper member 7 of longitudinal axis X, fastened to the neck 8 of the receptacle 2, for example, by snap-fastening. For this purpose, the wiper member 7 may include an annular shoulder 9 arranged to snap under the neck 8.

Figure 2:
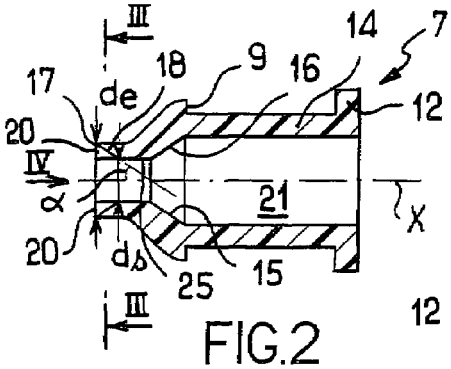
FIG. 2 is a diagrammatic axial section view of the wiper member of the device of FIG. 1.

The exemplary wiper member 7 is shown on its own in FIG. 2. As shown, the wiper member 7 may comprise an assembly skirt 14 terminated by a rim 12. The rim 12 may come to bear against an end edge 13 of the neck 8 of the receptacle 2 and may serve to ensure that closure of the receptacle 2 is leak-tight by being compressed by the cap 6 when the cap 6 is screwed home on the neck 8. The cap 6 may be fastened on the receptacle other than by screw-fastening, for example, by snap-fastening or by friction.

Figure 18:
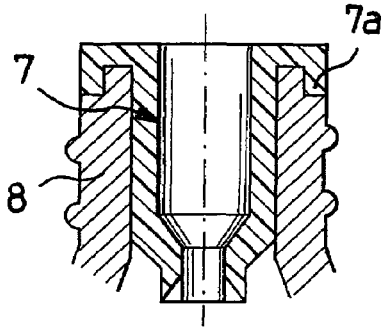
FIG. 18 shows an exemplary embodiment of fastening the wiper member on the receptacle.

FIG. 18 shows that the wiper member 7 may include an annular rim 7*a* so as to define a groove in which a top end of the neck 8 may be engaged.

As shown in FIG. 2, the assembly skirt 14 of axis X may be connected downward to an intermediate portion 15 disposed on the inside of the receptacle 2. The intermediate portion 15 may be extended by a wiper lip 17 with an outer cross-section that is smaller than that of the assembly skirt 14, for example.

The wiper member 7 may define an internal passage 21 through which the applicator member 4 passes longitudinally while being withdrawn from the receptacle 2.

In the wiper lip 17, the wiper member 7 may include at least one notch 20 that is not circularly symmetrical about the longitudinal axis X and that opens into the passage 21 so that the passage 21 comprises, at least one point along a length thereof, a cross-section that is not continuously circular.

Figure 3:
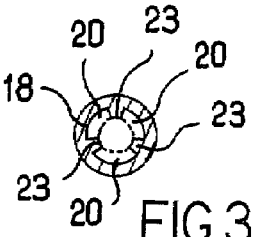
FIG. 3 is a diagrammatic cross-section view, taken along III-III in FIG. 2.
Figure 4:
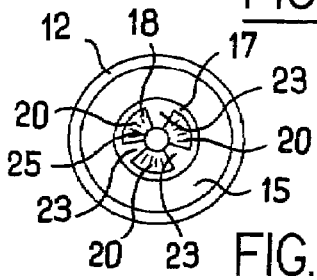
FIG. 4 is a diagrammatic end view of the wiper member of FIG. 2 as seen looking along arrow IV in FIG. 2.

As shown in FIG. 3, the wiper member 7 may include three identical notches 20 substantially uniformly distributed angularly around the axis X. It is contemplated that the wiper member 7 may include some other number of notches 20.

The notches 20 may be defined between splines 23 that project from a first insertion cone 18 formed inside the wiper lip 17 and converge toward the outlet from the receptacle. The insertion cone 18 may pass from an inlet diameter de to an outlet diameter ds, which may be at least 50% smaller than the inlet diameter de. For example, the inlet diameter de may be about 9 mm and the outlet diameter ds may be about 4 mm. Angle $\alpha$at the apex of the first insertion cone 18 may be in a range of about 5 ° to about 50°, for example.

The intermediate portion 15 may define a second insertion cone 16 that may facilitate return of the applicator member 4 into the receptacle 2, and that may converge toward the inside of the receptacle 2.

The first and second insertion cones 18, 16 may be connected together via an annular throat 25 with an inside cross-section that is continuously circular about the axis X, and with a diameter ds, for example, as shown.

The notches 20 may have a depth, i.e., a radial dimension, that decreases in a direction toward the outlet of the applicator member 4. The depth may decrease more quickly with increasing angle $\alpha$, with a bottom of the notches 20 being defined by the first insertion cone 18.

Each of the notches 20 may extend over an angular extent around the axis X that is less than one complete turn, for example, over an extent lying in a range of about 30° to about 90°.

The wiper member 7 may be substantially axially symmetrical about the axis X, but may not be circularly symmetrical, since the passage 21 has a cross-section that is not continuously circular, at at least one point along a length thereof, i.e., over that portion of the wiper lip 17 where the spline 23 extends, as shown in FIG. 3, for example.

In the exemplary embodiment shown, the wiper member 7 does not have fins that are moved by displacement of the applicator member 4. The wiper member 7 may be substantially undeformable as the applicator member 4 passes therethrough. For example, the inside section of the passage 21 of the wiper member 7 may increase by no more than about 10% while the applicator member 4 is passing therethrough.

For example, the wiper member 7 may be made of a plastics material, for example, an elastomer; however, it is contemplated that the wiper member 7 may be made of a material other than a plastics material, e.g., a metal, a resin, a glass, or a ceramic.

The splines 23 may contribute to orienting the macroparticles M parallel to the axis X while the applicator member 4 is engaged in the wiper member 7 during withdrawal of the applicator. The splines 23 may serve, for example, to comb the macroparticles M. In addition, by traveling in the notches 20, the macroparticles may be less subjected to wiping.

The presence of the notches 20 may thus make it possible to reduce any tendency of fibers and/or flakes to form aggregates at the inlet to the wiper member 7, and may enable the fibers and/or flakes to remain on the surface of the applicator member 4, which may improve the quality with which the substance is applied, for example, on the eyelashes or the eyebrows.

For example, after wiping, stripes of substance P having greater concentrations of fibers and/or flakes may be seen on the applicator member 4 extending in a direction substantially parallel to the longitudinal axis of the applicator member 4.

Figure 5:
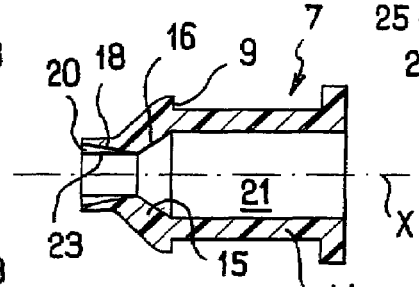
FIGS. 5 and 6 are diagrammatic axial section views of other exemplary embodiments of wiper members in accordance with the invention.

As shown in FIG. 5, it is contemplated that there may be no circularly cylindrical annular throat 25 between the insertion cones 16 and 18 of the wiper member 7.

In shown in FIG. 5, the splines 23 may extend longitudinally as far as the second insertion cone 1. The splines 23 may have radially inner sides thereof substantially parallel to the axis X, lying at a distance therefrom that corresponds substantially to half the diameter of the stem 5, for example.

Figure 6:
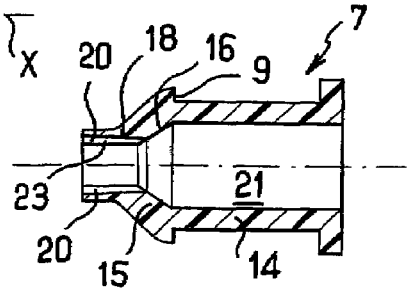

FIG. 6 shows that it is possible for the notches 20 to extend longitudinally toward the outlet from the receptacle beyond a smallest inside section of the passage 21, i.e., into the second insertion cone 16.

Figure 7:
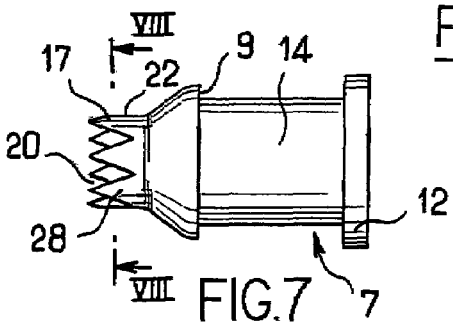
FIG. 7 is a diagrammatic side view showing another exemplary embodiment of a wiper member in accordance with the invention.

In the above description with reference to FIGS. 2, 5, and 6, each of the notches 20 may have a depth that decreases in a direction toward the outlet of the receptacle 2; however, it is contemplated that the notches 20 may have a radial dimension that remains substantially constant, as shown, for example, in FIG. 7.

Figure 8:
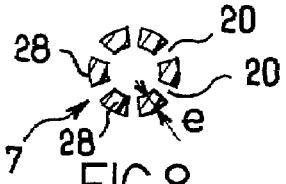
FIG. 8 is a diagrammatic section view taken along VIII-VIII in FIG. 7.
Figure 9:
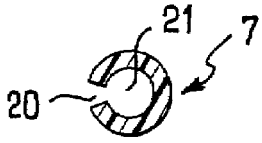
FIG. 9 is a view analogous to FIG. 8 showing another exemplary embodiment of a wiper member in accordance with the invention.

As shown in FIG. 7, the wiper lip 17 may be serrated, with the notches 20 formed between teeth 28 being of triangular shape and opening into the radially outer surface 22 of the wiper member. The lip 17 may have six notches 20, as shown in FIG. 8; but, it is contemplated that the wiper member 7 may have some other number of notches 20, e.g., a single notch 20, as shown in FIG. 9. The inside section of the wiper lip 17 may not be continuously circular because of the presence of the notch(es) 20 opening into the channel 21.

In the examples of FIGS. 7 and 9, the radial size of the notches 20 may correspond to the thickness e of the wiper lip 17. The inside diameter of the wiper lip 17 may be constant, e.g., corresponding to the outside diameter of the stem 15.

Figure 10:
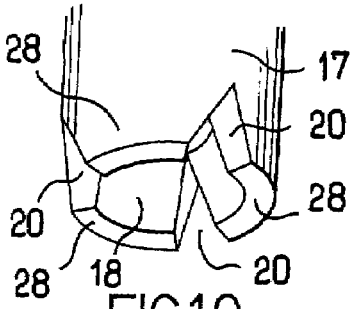
FIG. 10 is a fragmentary and diagrammatic perspective view showing another exemplary embodiment of a wiper member.

The inside diameter of the wiper lip 17 may also vary along the axis X, as shown in FIG. 10. As shown, the wiper lip 17 may include an inside diameter that decreases in a direction toward the outlet of the receptacle 2. As also shown, the teeth 28 may be truncated at their tips.

Figure 11:
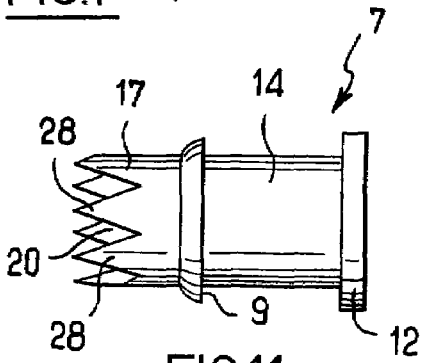
FIG. 11 is a diagrammatic side view showing another exemplary embodiment of a wiper member in accordance with the invention.

In all of the examples described above, the wiper member 7 includes a wiper lip 17 connected via a non-cylindrical intermediate portion 15 to the assembly skirt 14; however, it is contemplated that the wiper member 7 may not include such an intermediate portion 15 and the wiper lip 17 may lie externally, substantially in line with the assembly skirt 14, as shown in FIG. 11, for example.

Figure 12:
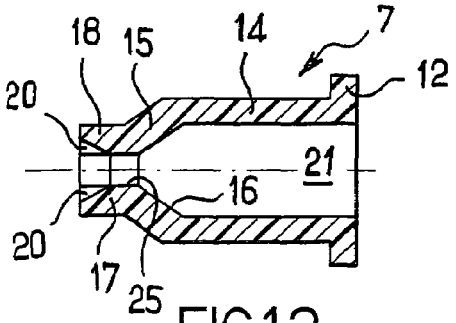
FIGS. 12 and 13 are diagrammatic axial section views of other exemplary embodiments of wiper members in accordance with the invention.

It is also contemplated that the wiper member 7 may be secured in the neck 8 of the receptacle 2, not by snap-fastening, but by any other means, e.g., by overmolding, adhesive, heat-sealing, or by friction, and need not include the shoulder 9, as shown in FIG. 12.

Figure 13:
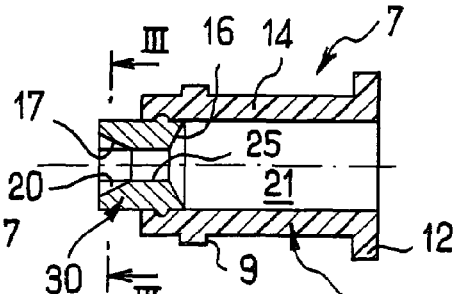

In all of the examples described above, the wiper member 7 is a single monolithic piece; however, it is contemplated that the wiper member 7 may comprise an assembly of at least two parts 30 and 31, as shown in FIG. 13.

For example, the part 30 may serve for fastening in the neck 8 and may comprise the assembly skirt 14 together with the shoulder 9 and the rim 12. The part 31 may include the wiper lip 17. In the exemplary embodiment shown, the parts 30 and 31 are fastened together by snap-fastening, but may be fastened together by other means, such as heat-sealing, adhesive, or friction. The part 30 may be made of a material that is optionally different from the material of the part 31. For example, the materials of the parts may be of different hardnesses. The part 31 may be overmolded on the receptacle, where appropriate or desired. For example, it is also possible for one of the parts 30 or 31 to be overmolded on the other.

Figure 20:
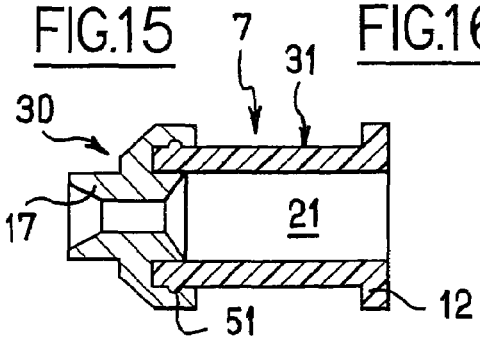

In the example of FIG. 13, the part 30 is fastened inside the part 31. In the embodiment of FIG. 20, the part 30 is fastened on a portion in relief 51, such as a bead or a groove on an outside surface of the part 31.

Figure 14:
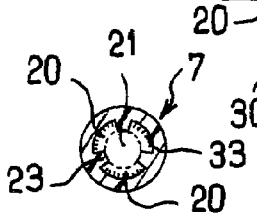
FIG. 14 is a diagrammatic section analogous to FIG. 3 showing another exemplary embodiment of a wiper member in accordance with the invention.

The wiper member 7 may receive any suitable coating or surface treatment, e.g., flocking 33, as shown in FIG. 14.

The first and second insertion cones are shown as having generator lines that are rectilinear; however, as used herein, the term "cone" should be understood more broadly as covering generally any funnel shape (not shown) that tapers overall, with a generator line that may produce a trumpet shape or that may be stepped.

Figure 17:
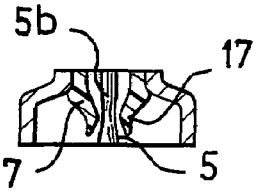
FIG. 17 shows an exemplary embodiment implementing a narrow region in the stem.

FIG. 17 shows that it is possible to make the stem 5 with a narrowed portion **5*b* that comes into position level (aligned) with the wiper lip 17 when the receptacle is closed with the applicator in place. The narrowed portion 5*b* may serve to ensure that the wiper lip 17** is not compressed while at rest, thereby reducing any risk of permanent deformation thereof.

Figure 19:
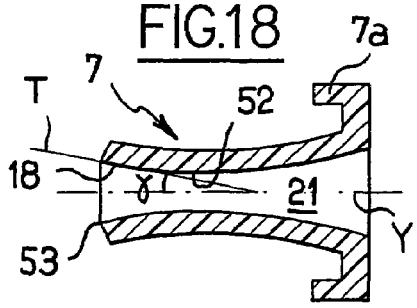
FIGS. 19 to 21 are diagrammatic axial section views of other exemplary embodiments of a wiper member.

FIG. 19 shows that it is possible to make the wiper member 7 with a passage 21 with a longitudinal section including a rounded profile, specifically being inwardly convex. For example, the cross-section may be circular passing through a minimum at 52. The first insertion cone 18 may have a generator line that is not strictly rectilinear. A tangent T at any point along said generator line, in a section plane containing the axis Y, makes an angle $\gamma$ with the axis Y, which angle may always be less than 90°, and, for example, may always be less than or equal to 60°.

At the minimum section 52, the tangent T may be substantially parallel to the axis Y, with the angle $\gamma$ decreasing on approaching the minimum section 52 starting from a distal end 53 of the wiper member 7. The diameter of the inside section may be chosen to be large enough to ensure that the wiper member 7 does not expand perceptibly when the applicator member 4 passes therethrough.

Figure 21:
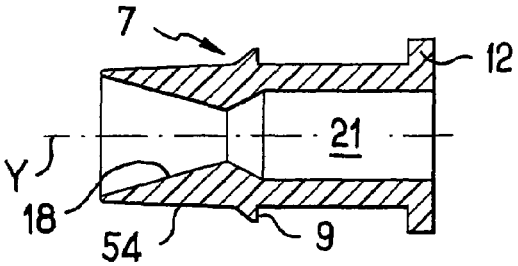

As illustrated by the exemplary embodiment shown in FIG. 21, the first insertion cone 18 may be formed by varying the thickness of a wall of the wiper member, while an outer surface 54 thereof remains circularly cylindrical.

The characteristics of the various exemplary embodiments described herein may be combined with one another to produce other variations that are not shown. For example, the wiper members of FIGS. 19 to 21 may include one or more notches 20.

Throughout the description, including in the claims, the term "comprises a" should be understood as being synonymous with "comprises at least one" unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention.

What is claimed is:

1. A device comprising:

a receptacle having an outlet;

a substance containing macroparticles, the substance being contained in the receptacle, the macroparticles being elongate in shape and individually perceivable by the naked eye;

an applicator comprising a stem and an applicator member capable of being inserted into the receptacle to take the substance therefrom; and a wiper member with a longitudinal axis and including a first insertion cone inside the receptacle, the first insertion cone converging toward the outlet of the receptacle, the first insertion cone being situated at a distal end of the wiper member, the wiper member including a throat area situated above the first insertion cone at least at one point along the longitudinal axis of the wiper member, the throat area including an inside surface being substantially continuously circular and of a diameter adapted to wiping the stem, and the first insertion cone including at least one notch formed between splines that extend from the first insertion cone, the notch having a radial dimension that decreases toward the outlet of the receptacle, and/or the first insertion cone including through notches formed between teeth, the teeth and through notches extending in the axial direction.

2. A device according to claim 1, wherein the first insertion cone includes at least one notch that is not circularly symmetrical about the longitudinal axis of the wiper member, and into which at least one of the applicator member and the substance on the applicator member penetrates at least in part while the applicator member is passing through the wiper member.

3. A device according to claim 1, wherein the wiper member comprises an elongate passage through which the applicator member passes while being withdrawn from the receptacle, the passage comprising, at at least one point along a length thereof, a cross-section that is not continuously circular, the wiper member being substantially undeformable while the applicator member is passing therethrough.

4. A device according to claim 1, wherein the wiper member does not deform perceptibly while the applicator member is passing therethrough, the wiper member comprising an inside section that varies over a major fraction of a distance between a distal end of the wiper member and a location where the inside section is a minimum.

5. A device according to claim 2, wherein the notch opens into an outer surface of the wiper member, situated inside the receptacle.

6. A device according to claim 5, wherein the notch includes a circumferential dimension that decreases toward the outlet of the receptacle.

7. A device according to claim 5, wherein the notch includes a radial dimension that decreases toward the outlet of the receptacle.

8. A device according to claim 5, wherein the notch opens at a longitudinal end of the wiper member which is situated inside the receptacle.

9. A device according to claim 5, wherein the first insertion cone includes one to ten notches.

10. A device according to claim 9, wherein the notches are substantially uniformly distributed angularly around a longitudinal axis of the wiper member.

11. A device according to claim 1, wherein the wiper member is substantially axially symmetrical.

12. A device according to claim 2, wherein the wiper member includes at least two splines projecting into the first insertion cone and forming said at least one notch therebetween.

13. A device according to claim 1, wherein the wiper member comprises a second insertion cone converging toward an inside of the receptacle.

14. A device according to claim 1, wherein the receptacle comprises a neck, and wherein the wiper member comprises an assembly skirt for fastening the wiper member in the neck.

15. A device according to claim 14, wherein the wiper member comprises, inside the receptacle, a wiper lip with a outer cross-section that is smaller than a cross-section of the assembly skirt.

16. A device according to claim 2, wherein the receptacle comprises a neck in which the wiper member is fastened, and wherein an overall diameter of a portion of the wiper member including the at least one notch is at least one of substantially constant and equal to an inside diameter of the neck.

17. A device according to claim 1, wherein the applicator member is fastened to an end of the stem of the applicator.

18. A device according to claim 17, wherein the stem comprises an outside cross-section that is substantially constant, and wherein a smallest section of a passage in the wiper member through which the applicator member passes while being withdrawn from the receptacle corresponds substantially to the outside cross-section of the stem.

19. A device according to claim 1, wherein an inside section of a passage in the wiper member through which the applicator member passes while being withdrawn from the receptacle increases by not more than 10% while the applicator member is passing through the wiper member.

20. A device according to claim 1, wherein the wiper member comprises a plastics material.

21. A device according to claim 20, wherein the wiper member comprises a material that is not cellular.

22. A device according to claim 1, wherein the wiper member comprises a material other than a plastics material.

23. A device according to claim 1, wherein the wiper member comprises a ceramic.

24. A device according to claim 1, wherein the wiper member is monolithic.

25. A device according to claim 1, wherein the wiper member comprises at least two parts that are assembled together.

26. A device according to claim 25, wherein each of the two parts comprises a different material.

27. A device according to claim 25, wherein each of the two parts comprises a material of a different hardness.

28. A device according to claim 1, wherein the wiper member comprises flocking.

29. A device according to claim 1, wherein the applicator member comprises a brush.

30. A device according to claim 29, wherein the brush comprises an envelope surface at a proximal end thereof with a cross-section that narrows in a direction going away from a distal end of the brush.

31. A device according to claim 29, wherein the brush comprises an envelope surface of cross-section that passes through a maximum between two longitudinal ends thereof.

32. A device according to claim 29, wherein the brush comprises an envelope surface of cross-section that passes through a minimum between two longitudinal ends thereof.

33. A device according to claim 1, wherein the substance comprises fibers.

34. A device according to claim 33, wherein a mean length of the fibers lies in a range of about 0.05 mm to about 3 mm.

35. A device according to claim 1, wherein the substance comprises flakes having a mean maximum dimension lying in a range of about 50 μm to about 1.5 mm.

36. A device according to claim 1, wherein the substance comprises at least 0.2% by weight of at least one of fibers and flakes.

37. A device according to claim 1, wherein the receptacle comprises a neck, and wherein the wiper member comprises an annular rim defining a groove in which a top end of the neck is engaged.

38. A device according to claim 17, wherein the stem comprises a narrowed portion that aligns with the wiper member when the applicator is in place on the receptacle.

39. A device according to claim 17, wherein the stem comprises a distal portion that tapers toward the applicator member.

40. A device according to claim 39, wherein the distal portion is conical.

41. A method of applying make-up using the device of claim 1, the method comprising:

using the applicator member to take substance from the receptacle;

subjecting the macroparticles, while withdrawing the applicator from the receptacle, to an action that tends to orient the macroparticles in a predefined manner on the applicator member; and applying the substance to a region of the human body.

42. A method according to claim 41, wherein the action orients the macroparticles substantially parallel to the longitudinal axis of the applicator member.

* * * * *